US007770401B2

(12) United States Patent
Nicholls

(10) Patent No.: US 7,770,401 B2
(45) Date of Patent: Aug. 10, 2010

(54) COMBUSTOR AND COMPONENT FOR A COMBUSTOR

(75) Inventor: Andrew P. Nicholls, Burton on Trent (GB)

(73) Assignee: Rolls-Royce plc, London (GB)

( * ) Notice: Subject to any disclaimer, the term of this patent is extended or adjusted under 35 U.S.C. 154(b) by 309 days.

(21) Appl. No.: 11/520,669

(22) Filed: Sep. 14, 2006

(65) Prior Publication Data

US 2007/0084217 A1 Apr. 19, 2007

(30) Foreign Application Priority Data

Oct. 15, 2005 (GB) ..... 0521013.3

(51) Int. Cl.
*F02C 7/20* (2006.01)

(52) U.S. Cl. ..... 60/799; 60/800; 60/752; 60/798

(58) Field of Classification Search ..... 60/752, 60/798, 779, 39.091, 39.094, 799, 800, 796; 220/749, 745–750; 239/397.5
See application file for complete search history.

(56) References Cited

U.S. PATENT DOCUMENTS

| | | | | |
|---|---|---|---|---|
| 4,875,339 | A * | 10/1989 | Rasmussen et al. | 60/757 |
| 4,999,996 | A * | 3/1991 | Duchene et al. | 60/798 |
| 6,351,949 | B1 | 3/2002 | Rice et al. | |

FOREIGN PATENT DOCUMENTS

| | | |
|---|---|---|
| EP | 0 318 312 | 5/1989 |
| GB | 1 467 720 | 5/1977 |
| GB | 2 003 989 | 5/1979 |
| GB | 2 049 913 | 12/1980 |
| JP | A 58-113656 | 7/1983 |

* cited by examiner

*Primary Examiner*—Michael Cuff
*Assistant Examiner*—Vikansha S Dwivedi
(74) *Attorney, Agent, or Firm*—Oliff & Berridge, PLC

(57) ABSTRACT

A sacrificial liner is provided for an injector access aperture in a combustor casing. The liner has an outer annular surface and an eccentric inner annular surface. The liner serves to protect the combustor outer casing from wear by a series of piston rings mounted in a seal carrier. The eccentricity of the surfaces prevent excess contact pressure between the piston rings and the seal carrier to improve the life of these components.

9 Claims, 5 Drawing Sheets

COMBUSTOR AND COMPONENT FOR A COMBUSTOR

This invention concerns a combustor for a gas turbine engine and in particular a lining for an injector access aperture of a combustor for a gas turbine engine.

A combustor in a gas turbine is typically formed with an outer casing and support casing. Both the outer casing and the support casing are provided with apertures through which a fuel injector is inserted.

The outer casing and the support casing are spaced radially from each other when referenced to the engine axis and the cavity between the two casings contains compressed air that acts to cool both the components.

The fuel injector is mounted to the support casing and a seal is provided at the aperture of the outer casing to prevent loss of compressed air and prevent the efficiency of the engine being reduced through this loss.

The seal of the prior art is provided by a concentrically machined seal liner that is freeze fitted and bolted into the combustor outer casing, and a piston ring mounted to the injector. The seal liner acts as a sacrificial wear surface for the contact surface with the piston ring.

At the location of the fuel injector access hole the support casing is axially built forwards relative to the outer casing. During operation of the engine thermal expansion causes the support casing and outer casing to grow both radially and axially. Typically, the support casing expands more quickly than the outer casing and the seal accommodates such movement.

In the concentrically machined piston seal, liner a very small contact area is exposed at the rearward position of the piston seal carrier when assembled. The small contact area exhibits high contact pressure during operation that causes both distortion and premature wear of both the piston rings and liner.

It is an object of the present invention to seek to provide a liner and combustor with a liner that exhibits an improved life.

According to the present invention there is provided a liner for an injector access aperture in a combustor casing, wherein the liner has an outer annular surface and an inner annular surface and wherein the inner and outer surfaces of the liner are eccentric.

The outer surface of the liner may have a flange for attaching the liner to a combustor casing.

According to a second aspect of the invention there is provided a combustor for a gas turbine engine having an outer casing having an access aperture through which an injector may be inserted, the aperture being defined by an annular surface that extends about a first axis;

wherein the outer casing is provided with a liner that has an outer annular surface and an inner annular surface wherein the outer annular surface abuts the annular surface of the outer casing aperture and extends about the first axis and wherein the inner annular surface extends about a second axis.

Preferably the outer surface of the liner has an interference fit with the aperture in the outer casing.

The combustor may further comprises an inner casing and an injector mounted thereto, wherein the injector is movable relative to the outer casing, and has sealing means that provides a seal between the injector and the liner.

Preferably the sealing means comprises a seal carrier mounted to the injector and an annular ring carried by the seal carrier, the annular ring contacting the liner.

The combustor of the invention may be incorporated into a gas turbine engine.

Embodiments of the present invention will now be described by way of example only and with reference to the accompanying drawings, in which:—

Figure 1:
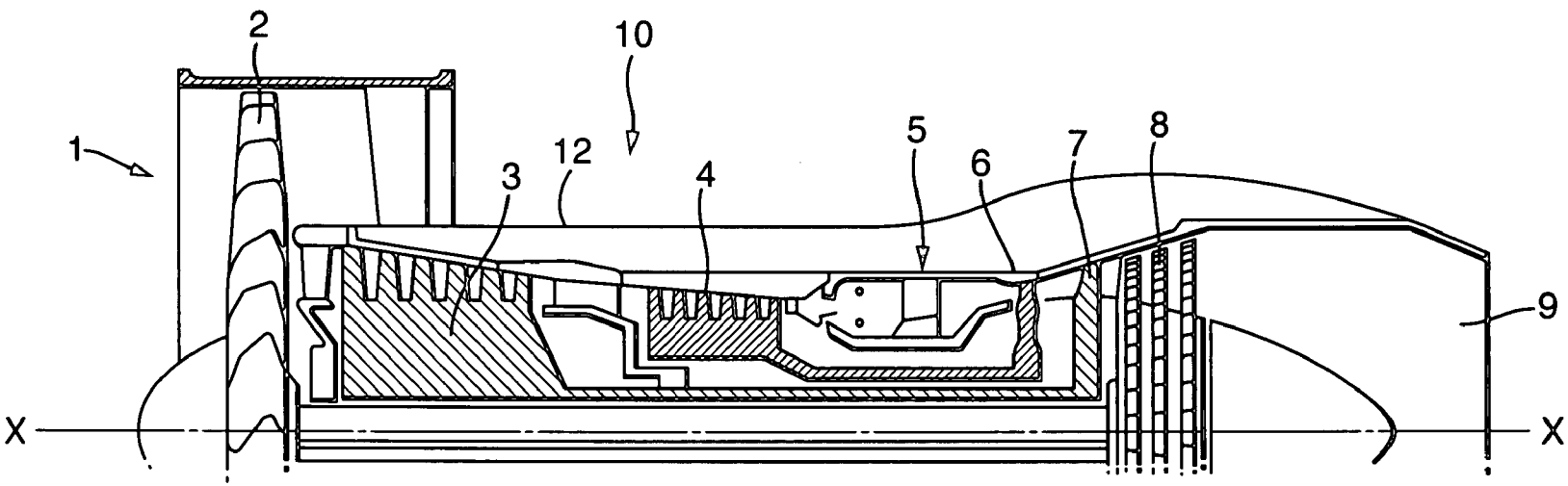
FIG. 1 is a schematic of a ducted gas turbine engine incorporating a seal liner in accordance with the invention.

With reference to FIG. 1, a ducted fan gas turbine engine generally indicated at 10 comprises, in axial flow series, an air intake 1, a propulsive fan 2, an intermediate pressure compressor 3, a high pressure compressor 4, combustion equipment 5, a high pressure turbine 6, an intermediate pressure turbine 7, a low pressure turbine 8 and an exhaust nozzle 9.

Air entering the air intake 1 is accelerated by the fan 2 to produce two air flows, a first air flow into the intermediate pressure compressor 3 and a second air flow that passes over the outer surface of the engine casing 12 and which provides propulsive thrust. The intermediate pressure compressor 3 compresses the air flow directed into it before delivering the air to the high pressure compressor 4 where further compression takes place.

Compressed air exhausted from the high pressure compressor 4 is directed into the combustion equipment 5, where it is mixed with fuel and the mixture combusted. The resultant hot combustion products expand through and thereby drive the high 6, intermediate 7 and low pressure 8 turbines before being exhausted through the nozzle 9 to provide additional propulsive thrust. The high, intermediate and low pressure turbines respectively drive the high and intermediate pressure compressors and the fan by suitable interconnecting shafts.

Figure 2:
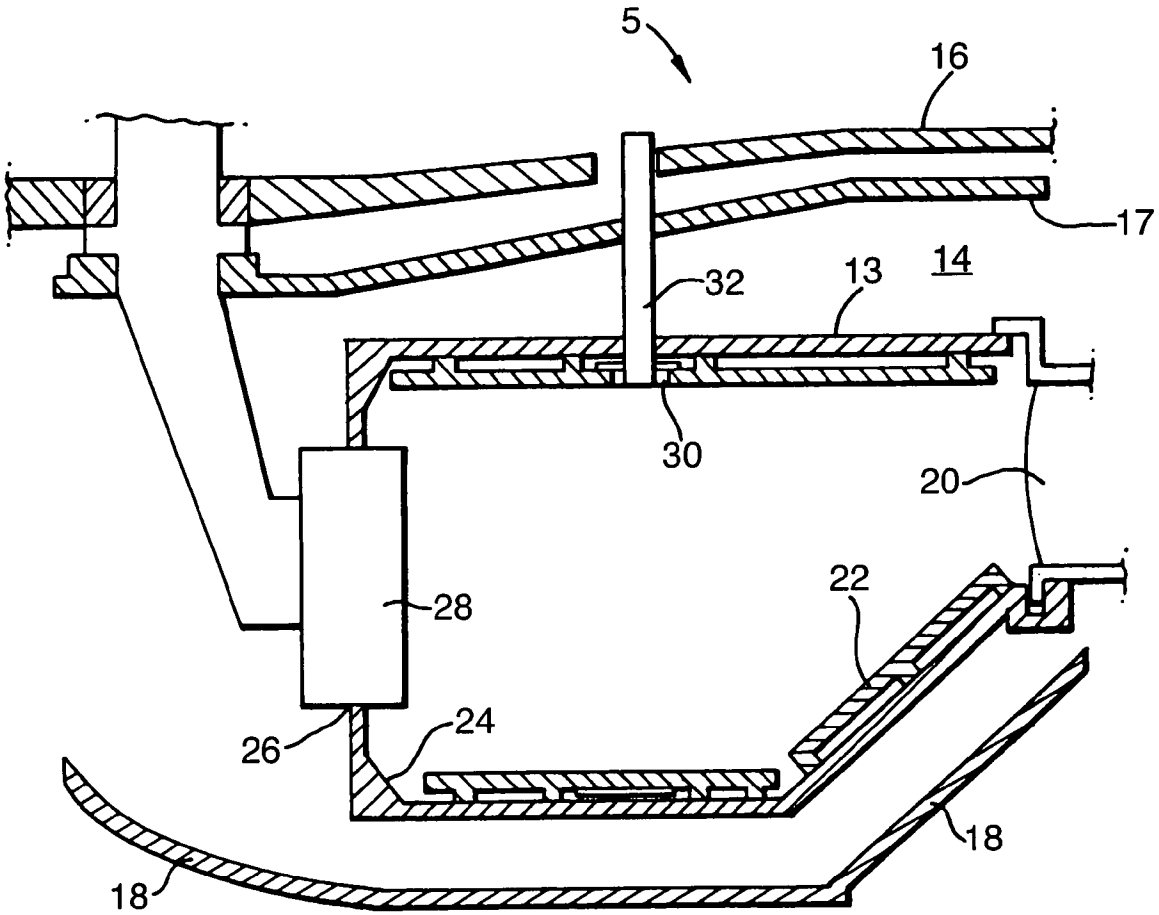
FIG. 2 is a schematic of a combustor incorporating a seal liner in accordance with the invention.

Referring to FIG. 2, the combustion section 5 of a gas turbine aero engine is illustrated with the adjacent engine parts omitted for clarity, that is the compressor section upstream of the combustor (to the left of the drawing in FIG. 1) and the turbine section downstream of the combustion section. The combustion section comprises an annular type combustion chamber 13 positioned in an annular region 14 between a combustion chamber outer casing 16, which combined with the support casing 17 is part of the engine casing structure and radially outwards of the combustion chamber, and a combustion chamber inner casing 18, also part of the engine structure and positioned radially inwards of the combustion chamber 13. The inner casing 18, outer casing 16 and support casing 17 comprise part of the engine casing load bearing structure and the function of these components is well understood by those skilled in the art. The combustion chamber 13 is cantilevered at its downstream end from an annular array of nozzle guide vanes 20, one of which is shown in part in the drawing of FIG. 2. In this arrangement the combustion chamber may be considered to be a non load bearing component in the sense that it does not support any loads other than the loads acting upon it due to the pressure differential across the walls of the combustion chamber.

The combustion chamber comprises a continuous heat shield type lining on its radially inner and outer interior surfaces. The lining comprises a series of heat resistant tiles 22 which are attached to the interior surface of the radially inner and outer walls of the combustor in a known manner. The upstream end of the combustion chamber comprises an annular end wall 24 which includes a series of circumferentially spaced apertures 26 for receiving respective air fuel injection devices 28. The radially outer wall of the combustion chamber includes at least one opening 30 for receiving the end of an ignitor 32 which passes through a corresponding aperture in the outer casing 16 on which it is secured.

Figure 3:
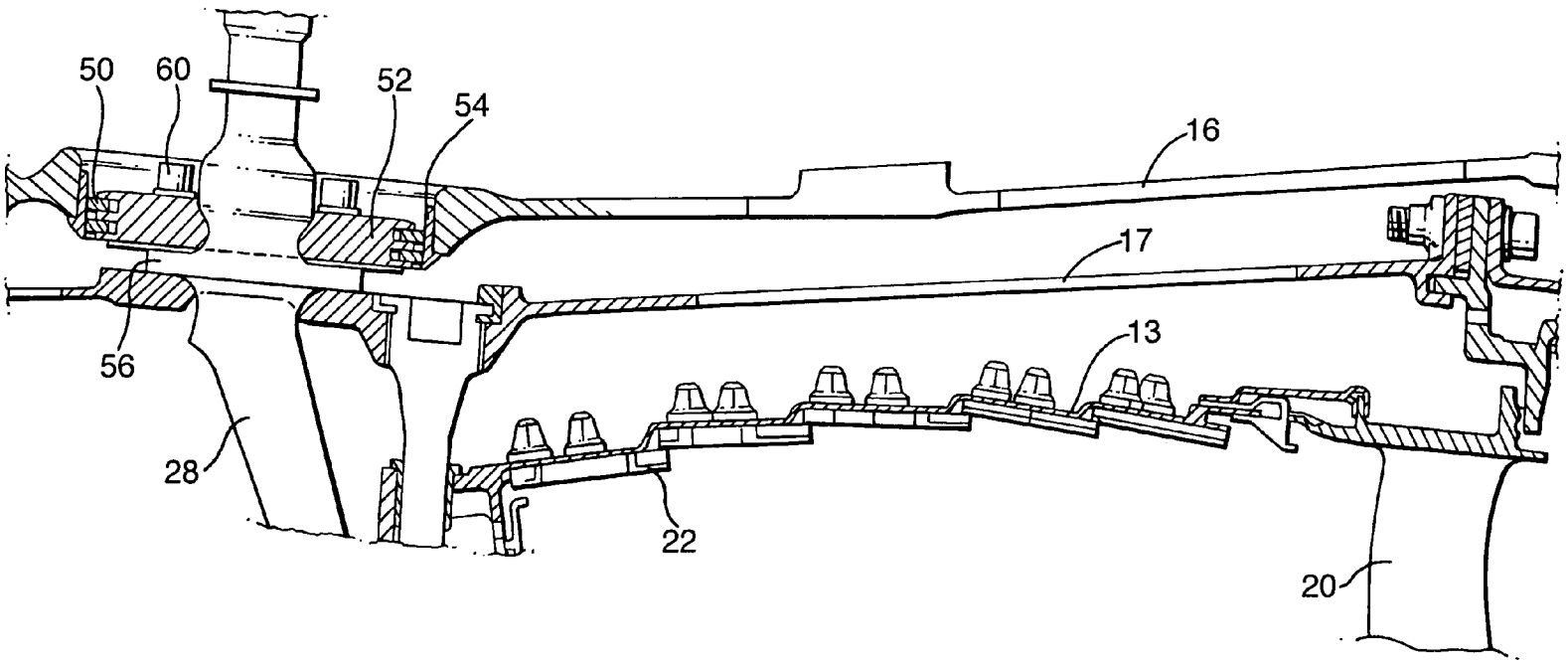
FIG. 3 depicts the combustor of FIG. 2 in greater detail.

FIG. 3 depicts more details of the radially outer portions of the combustion chamber, and the combustor outer casing and support casing. Also depicted in greater detail is the mounting of the fuel injector 28 to the support casing 17 and the seal 50, 52, 54 between the injector 28 and the combustor outer casing 16. The fuel injector access through the support and outer casing is further shown in greater detail in FIG. 4.

The outer combustor casing 16 is provided with an aperture through which the fuel injector 28 is inserted. The fuel injector comprises a tubular shaft with flange 56 formed integrally therewith. A seal carrier 52 is bolted to the flange 56 by a plurality of bolts 60, the bolts also serve to mount the flange 56 to the support casing 17 and therefore the injector 28, which extends through an aperture in the support casing 17.

'O' rings 58 are provided to seal between the faces of the flange 56 and the support casing 17 and the seal carrier 52.

The seal carrier is ring shaped and has an inward facing annular surface 70 and an outward facing annular surface 72. The outward facing annular surface has a first and second groove, the grooves 64 being spaced apart in the direction of ring thickness.

Within each groove there is located an outward sprung annular piston ring serving as seal 50. The piston rings are held within the grooves by an inner annular surface of a liner 54. The liner is a disposable item that serves to protect the combustor outer casing from wear by the piston rings.

An injector access aperture in the outer combustor casing has an annular surface 62 and the liner is sized such that the outer surface thereof creates an interference fit within the aperture. A flange 55 serves to locate the liner 54 at a predetermined axial location in the aperture.

The inner axial surface of the liner extends about a first axis, whilst the outer annular surface of the liner extends about a second axis. In this way the inner annular surface and the outer axial surface are eccentric. The liner is shown in plan view in FIG. 5.

Figure 5:
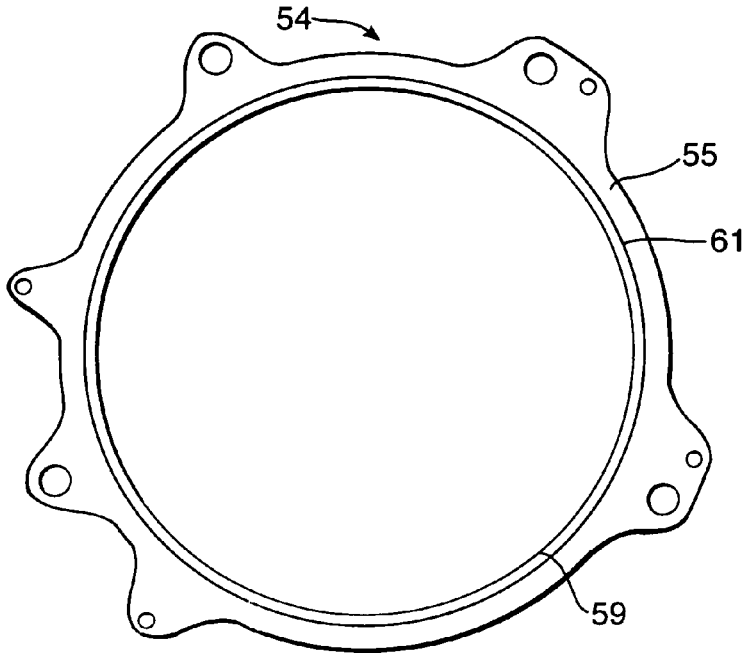
FIG. 5 is a plan view of a liner in accordance with the invention.

FIG. 5 shows clearly the eccentric inner 59 annular and outer 61 annular surfaces create a region of the circumference of the liner 54 that is relatively thin and region of the liner 54 that is relatively thick. The liner is arranged within the aperture such that the thinner portion of the circumference is located axially in front of the thicker portion of the circumference when referenced to the engine axis and the direction of airflow therethrough.

At the location of the fuel injector access hole, the combustor support casing 17 is axially built forward relative to the combustor outer casing. During engine operation the high temperatures generated by the combustor cause the support casing and the outer casing to expand by thermal expansion.

Each component can expand both by a different amount and at a different rate to the other and the seal at the outer combustor casing floats within the aperture to maintain an effective seal.

Figure 4:
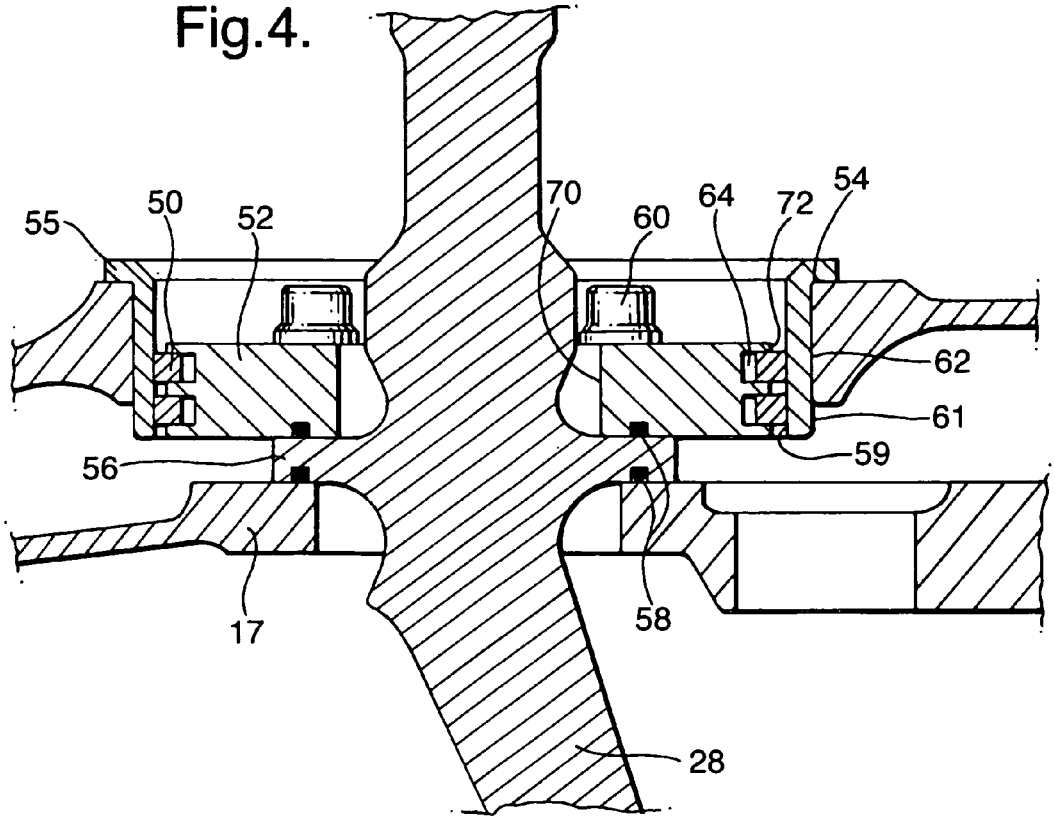
FIG. 4 depicts an injector access aperture incorporating a liner in accordance with the invention.
Figure 6:
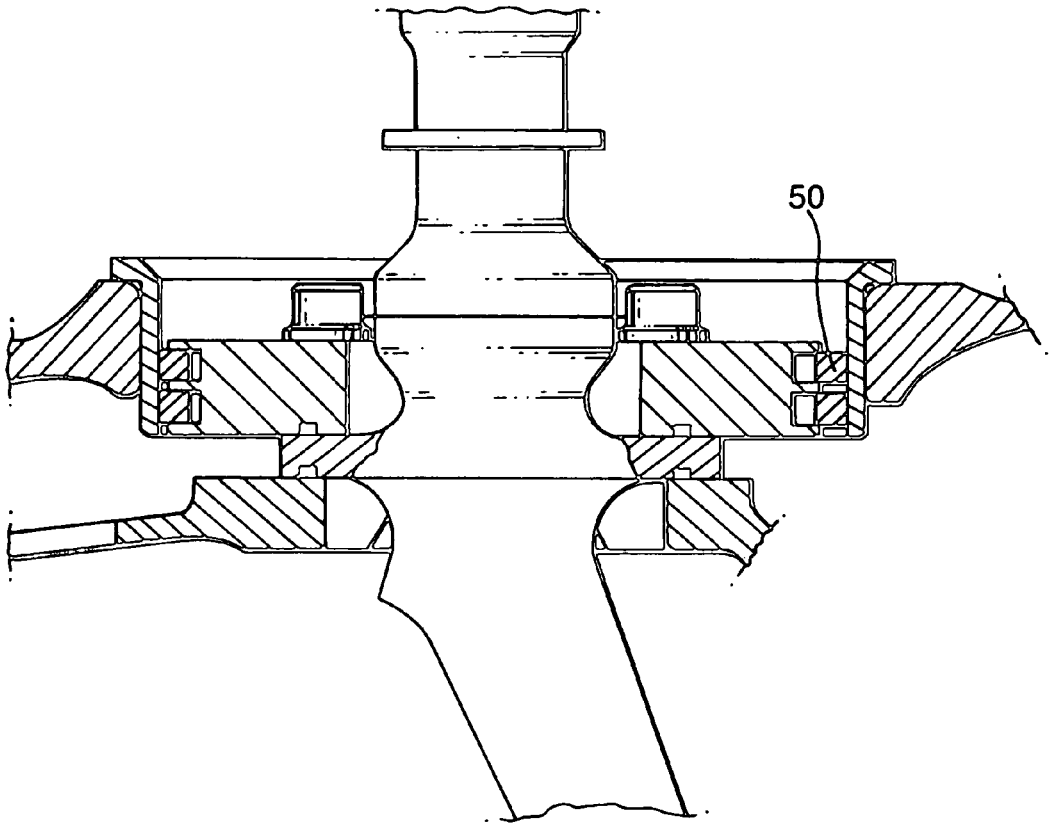
Fig.6. (Prior Art)
FIG. 6 depicts an injector access aperture incorporating a liner in accordance with the prior art.

The improvement and advantage of the invention can be clearly noted by comparing the prior art seal liner of FIG. 6 with the seal liner of the present invention as depicted in FIG. 4. Both figures depict the seal arrangement at the point where the engine is cool. The piston rings 50 supported by the seal carrier 52 contact the seal liner 54 to provide a seal.

The aperture of the combustor support casing is arranged about an axis that is offset from the axis about which the aperture in the outer casing extends. The offset is such that the axis of the aperture of the support casing is axially forward of the axis of the aperture in the outer casing. In the case where the liner is concentric, at the engine conditions of FIG. 6 the piston rings are exposed to a very small contact area at the rearward position of the seal carrier. Of course, the contact area will increase as the temperature of the engine and consequently the support casing and outer casing increases, but the high contact pressure causes distortion and premature wear to the piston rings 50.

By contrast, the seal liner of FIG. 4 is eccentric and beneficially, despite the axial offset between the aperture in the support casing and the aperture in the outer casing, a larger contact area is presented between the seal carrier 52 and the piston rings 50. The larger contact area reduces the contact pressure during engine operation and consequently reduces distortion and wear in the seal.

It will be appreciated that the modified liner provides a simple and elegant solution to the problem. Various modifications may be made without departing from the scope of the invention.

I claim:

1. A combustor for a gas turbine engine having an outer casing having an access aperture through which an injector is inserted;

wherein the outer casing is provided with a single piece liner inserted within the access aperture, the single piece liner having a single annular wall of varying thickness having an outer annular surface and an inner annular surface and wherein the outer annular surface extends about a first axis and the inner annular surface extends about a second axis so that the inner and outer annular surfaces of the wall are eccentric.

2. A combustor according to claim 1, wherein the outer surface of the liner has an interference fit with the aperture in the outer casing.

3. A combustor according to claim 1, wherein the combustor further comprises an inner casing and an injector mounted thereto, wherein the injector is movable relative to the outer casing, and has sealing means that maintains a seal between the injector and the single piece liner during the relative movement of the injector.

4. A combustor according to claim 3, wherein the sealing means comprises a seal carrier mounted to the injector and an annular ring carried by the seal carrier, the annular ring being positioned within a groove of the seal carrier, the annular ring contacting and being held within the groove by the inner annular surface of the single piece liner.

5. A gas turbine engine incorporating a combustor according to claim 1.

6. A combustor for a gas turbine engine comprising:

an outer casing having an access aperture through which an injector is inserted, wherein the outer casing is provided with a single piece liner inserted within the access aperture, the single piece liner having an outer annular surface and an inner annular surface and wherein the inner and outer surfaces of the single piece liner are eccentric;

an inner casing; and an injector mounted to the inner casing, wherein the injector is movable relative to the outer casing, and has sealing means that maintains a seal between the injector and the single piece liner during the relative movement of the injector.

7. A combustor according to claim 6, wherein the outer surface of the liner has an interference fit with the aperture in the outer casing.

8. A combustor according to claim 7, wherein the sealing means comprises a seal carrier mounted to the injector and an annular ring carried by the seal carrier, the annular ring being positioned within a groove of the seal carrier, the annular ring contacting and being held within the groove by the inner annular surface of the single piece liner.

9. A gas turbine engine incorporating a combustor according to claim 6.

* * * * *